US006029364A

United States Patent [19]

Pickett

[11] Patent Number: 6,029,364

[45] Date of Patent: Feb. 29, 2000

[54] COMBINATION HAIR DRYER COVER AND HEAD SHIELD

[76] Inventor: Sharron Pickett, 15411 Birwood, Detroit, Mich. 48238

[21] Appl. No.: 09/032,726

[22] Filed: Feb. 27, 1998

Related U.S. Application Data

[63] Continuation-in-part of application No. 08/994,058, Dec. 19, 1997.

[51] Int. Cl.[7] ..... A45D 20/18

[52] U.S. Cl. ..... 34/99; 2/174

[58] Field of Search ..... 34/96, 97, 98, 34/99, 100; 2/174

[56] References Cited

U.S. PATENT DOCUMENTS

| | | | |
|---|---|---|---|
| 1,543,423 | 6/1925 | Coune | 34/99 |
| 2,474,165 | 6/1949 | Roberts | 34/99 |
| 3,043,016 | 7/1962 | Miller | 34/99 |
| 4,133,052 | 1/1979 | Hodgman et al. | 2/174 |
| 4,704,744 | 11/1987 | Myers | 2/174 |
| 5,029,404 | 7/1991 | Terrell | 34/99 |
| 5,218,772 | 6/1993 | Dickson, Sr. | 34/99 |

*Primary Examiner*—Pamela A. Wilson
*Attorney, Agent, or Firm*—Gerald R. Black

[57] ABSTRACT

The combination hair dryer cover and head shield is for use with a hood-type hair dryer and is useful for protecting the forehead, features and neck of the user from excess heat being emitting from the hair dryer. The apparatus comprises a hood cover and a head shield which are stitched together around the perimeter of a common seam. The apparatus will protect uncovered portions of the patrons' head from heat energy from the hair dryer. The shield cover and the hood cover are each made of a clear plastic material. The hood cover is secured onto the hood by an elastic band and the shield is retained onto the head of the patron by another elastic band. The hood cover can be readily separated from the head shield along perforations disposed about the perimeter of the head shield proximate to the head shield elastic band positioned about the hairline of the patron. Once separated, the hood cover is discarded, the head shield can thereafter be used as needed.

9 Claims, 3 Drawing Sheets

COMBINATION HAIR DRYER COVER AND HEAD SHIELD

This application is a continuation-in-part of application Ser. No. 08/994,058 filed Dec. 19, 1997.

FIELD OF USE

The invention relates to a device for use in a beauty salon for drying and setting hair, and more particularly, to a device that directs heat from the hair dryer onto the patron's hair in an energy efficient manner.

BACKGROUND OF THE INVENTION

The conventional hood hair dryer is outdated for many hair drying applications.

Instead, it is being used primarily as a means to direct heat energy to the hair—in other words, to warm the hair and not necessarily to dry it. When heat is applied with a hair conditioner, hair coloring, or a perm, the styling and conditioning of the hair is enhanced.

U.S. Pat. No. 4,133,052 (Hodgman) discloses a face guard for use with a hooded hair dryer. The face guard is secured about the forehead and is retained onto the back of the head by hook-and-loop fasteners. A first portion of the face guard covers the forehead, eyes, and nose and opposing second portions cover the ears protecting such features from excess heat exhausted from the hair dryer.

U.S. Pat. No. 4,704,744 (Myers) discloses a neck and face shield to be worn by a person while sitting under a hood-type hair dryer. The shield includes a visor extending around its perimeter so that most of the heat is deflected from the exhausted air away from the face and neck of the patron. The shield is also adjustable with hook-and-loop type fasteners to fit onto heads of various shapes and sizes.

U.S. Pat. No. 5,029,404 (Terrell) discloses an attachable quick dry diffuser complete with a drawstring and hook-and-loop type fasteners which provide adjustment means for various head sizes. The apparatus prevents overheating of the head and face, and reduces drying processing time thereby saving energy.

U.S. Pat. No. 5,218,772 (Dickson) discloses a hair dryer hood conduit which fits onto a person's head and minimnizes heat loss. The conduit includes roll-up coverings disposed about the conduit which cover screens to enable temperature adjustment, and a temperature sensor is optional.

While head covers have been used to cover the hair of the patron, these head covers are generally used to enable an even distribution of heat to be applied to all hair to be treated. Such covers have substantial heat losses and can cause substantial discomfort to the wearer.

What is needed is a device that will minimize the amount of time needed to heat the patron's hair while not wasting heat energy.

What is needed is a device that will be comfortable to the patron and will reduce the noise level during use.

What is needed is a device that is adjustable for various head sizes and fully adaptable for patrons of varying heights.

What is needed is a device that is readily disposable thereby preventing the spread of disease from patron to patron.

What is needed is a device that is easy to use and will not dry the patron's hair.

What is needed is a device that is inexpensive to make, that is made from conventional materials, and that is disposable after use by each patron for sanitation purposes.

SUMMARY OF THE INVENTION

The combination hair dryer cover and head shield of the present invention prevents the hair from drying out when the perm, hair color, or conditioner is being used on the hair; keeps hair chemicals contained under the cap not on the dryer; keeps the heat on the head and away from the ears or the face; reduces the noise level under the dryer; is energy efficient and requires less processing time; is constructed of durable and reliable materials; is adjustable to fit all head sizes; decreases hair drying time; is inexpensive to manufacture with regard to both labor and materials; and is disposable for sanitary reasons.

The combination hair dryer cover and head shield apparatus of the present invention is primarily for use with a hair dryer, but can also be used in other applications such as a hand warmer or a foot warmer. The apparatus includes a hood cover and a heat shield.

One end of the hood cover is mounted during engagement upon the hood of the hair dryer. The heat shield includes one end portion adjustably retained over the scalp and hair, and onto the head of the patron, and the second shield end portion is securely attached to an end of the hood cover. The shield and the cover share a common perimeter, as essentially all of the shield perimeter being attached to essentially the entire perimeter.

The combination of the hood cover and the heat shield protects portions of the head and face that are not covered from heat energy from the hair dryer. To ensure that the thin plastic apparatus of the present invention is not blown off from the hair dryer once the hair dryer is engaged, more than one retainer may be needed. Also, the source cover includes vents through which some excess heat energy is allowed to escape.

A second embodiment of the apparatus of the present invention involves one end of the hood cover being affixed onto the hair-dryer and the other end of the hood cover is placed and retained onto the head of the patron. To ensure that the thin plastic hood cover is not blown off from the hair dryer once the hair dryer is engaged, more than one retaining means may be needed. The first retainer is preferably an elastic band which is mounted within the outer perimeter of the hood, the elastic band being retained thereabout. The second retainer is preferably a flexible strap that is generally normal to the elastic band when positioned about and retained onto the hair dryer hood.

For a more complete understanding of the combination hair dryer cover and head shield of the present invention, reference is made to the following detailed description and accompanying drawings in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention. Throughout the description, like reference numbers refer to the same component throughout the several views.

DETAILED DESCRIPTION OF THE PREFERRED EMBODIMENTS

Figure 1:
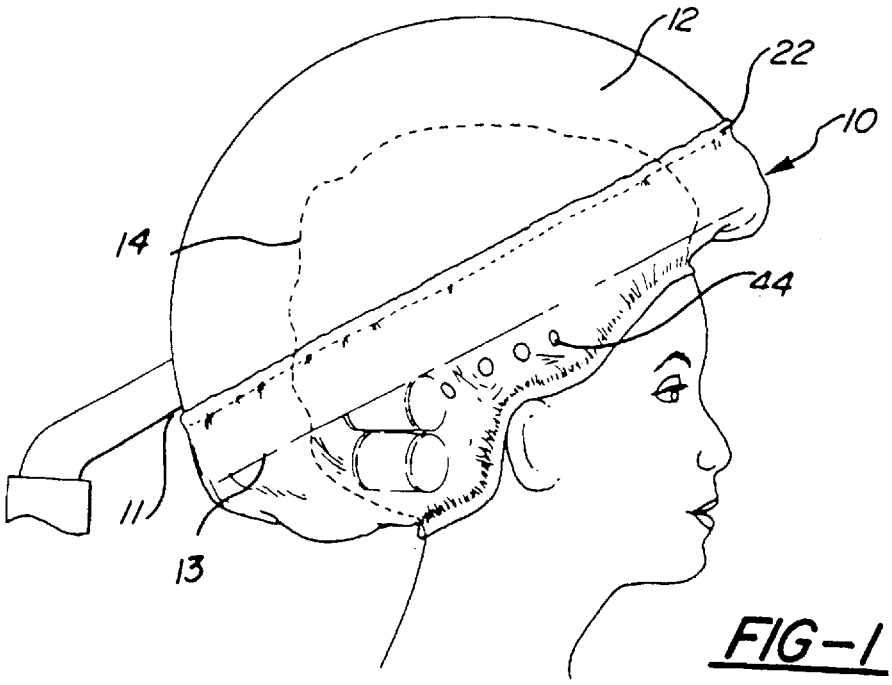
FIG. 1 is a side elevational view of a first embodiment of the combination hair dryer cover and head shield of the present invention as mounted relative to a hood type hair dryer, the head of the patron being within the hair dryer.
Figure 2:
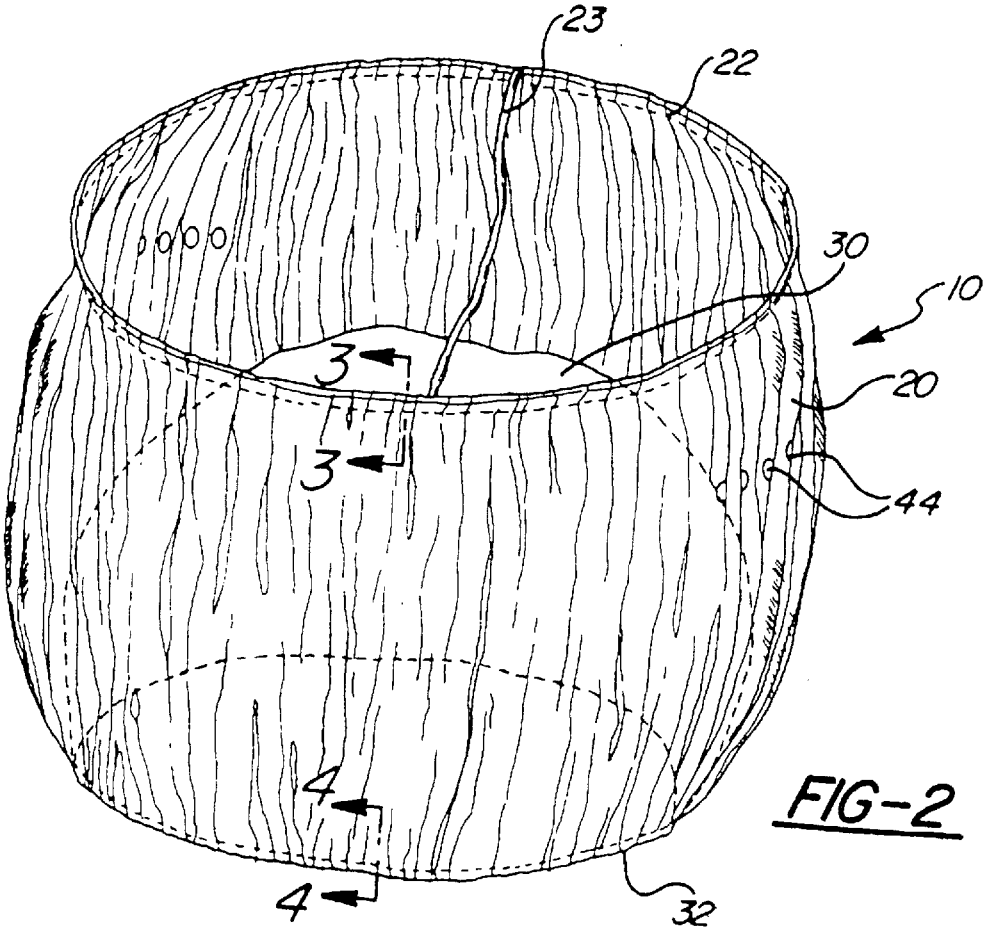
FIG. 2 is a front view of a first embodiment of the combination hair dryer cover and head shield of FIG. 1.

Referring now to the drawings, FIGS. 1 and 2 disclose the first embodiment of the combination hair dryer cover and head shield apparatus of the present invention. The heat directing apparatus [10] is primarily for use with a heat source that supplies heat energy by convection , or hair dryer [12] can also be used in other applications such as a hand warmer or a foot warmer. The apparatus [10] includes a source cover or a hood cover [20] and an object cover or head shield [30].

Figure 5:
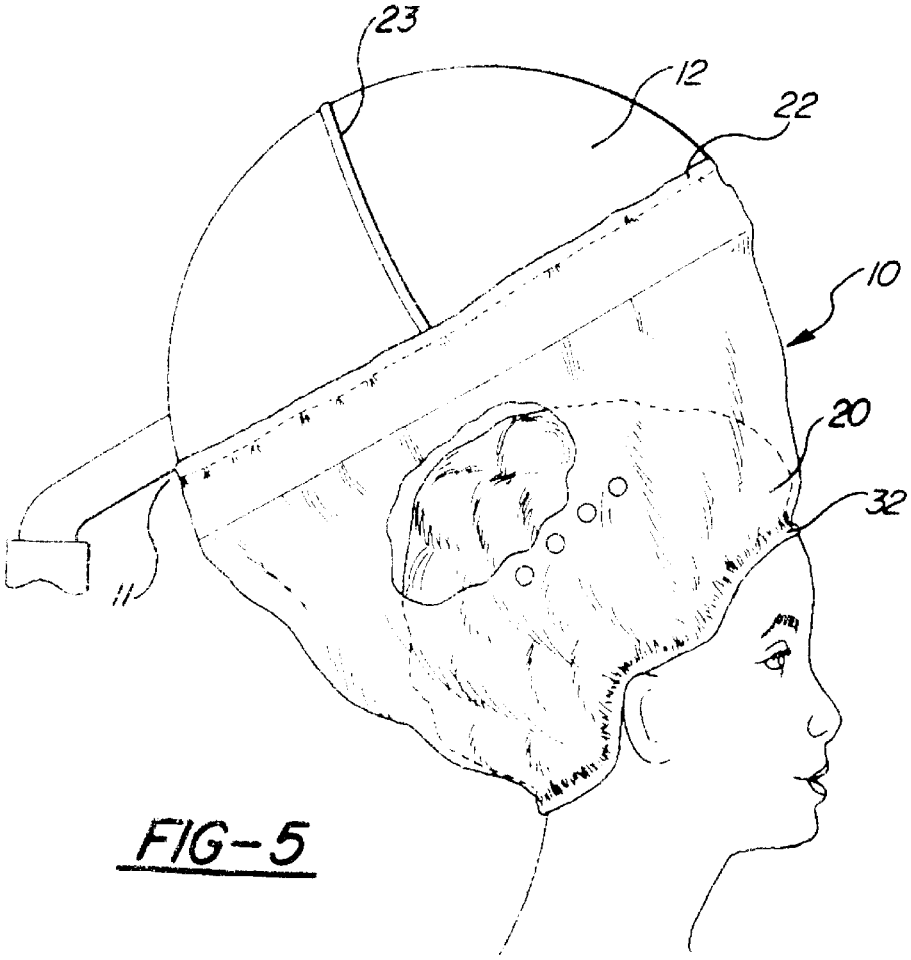
FIG. 5 is a side elevational view of the first embodiment of the combination hair dryer cover and head shield of FIG. 1 as mounted relative to a hood type hair dryer, the head of the patron being within the hair dryer.

FIG. 1 discloses the head of the patron positioned within the hood [15] of the hair dryer [12], while FIG. 5 discloses the head of the patron removed from the hood [15], as shown in FIG. 5. Hence, the apparatus [10] of the present invention is adaptable for patrons of varying heights, and also enables the patron to be removed from the hood [15], thereby reducing noise levels.

Figure 3:
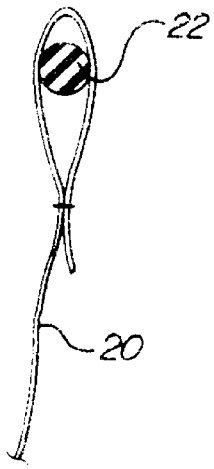
FIG. 3 is a cross-sectional view of the elastic band of the upper portion of the combination hair dryer cover and head shield of FIG. 1.

One end of the hood cover [20]. The hood cover [20] has a generally cylindrical shape, one end portion [21] of which is affixed to the hair-dryer hood [15] and the other end portion [31] being affixed about the head [14] of the wearer is mounted during engagement upon the hood [15] of the hair dryer [12]. A first hood cover retainer or a first source cover end portion [22] as shown in FIG. 3 can be any conventional fastener, such as tape, hook-and-loop type fasteners, but is preferably an elastic band positioned within the perimeter of the end of the hood cover [20].

The head shield [30] is retained onto the head [14] of the person using the hair dryer [12]. A first head shield retainer or a second source cover end portion [32] can be any conventional fastener, such as tape, hook-and-loop type fasteners, but is preferably an elastic band positioned within the perimeter of the end of the head shield [30]. The first retainer [32] may be a conventional rubber band or a rubber band that requires the ends to be tied together.

Figure 4:
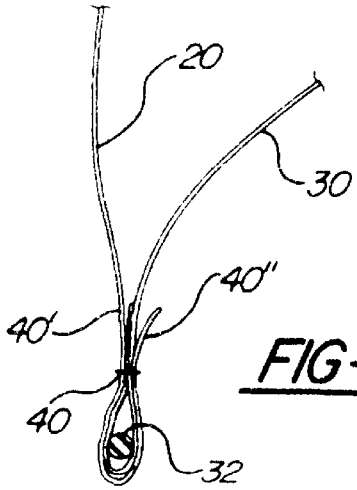
FIG. 4 is a cross-sectional view of the elastic band of the lower portion of the combination hair dryer cover and head shield of FIG. 1.

The head shield [30] is adjustably retained over the scalp and hair, and onto the head [14] of the patron. The shield [30] and the cover [20] share a common perimeter [40], as essentially the entire perimeter [40'] of the hood cover [20] is attached to essentially the entire perimeter [40"] head shield [30] as shown in FIG. 4.

The combination of the hood cover [20] and the head shield [30] protects uncovered portions of the head [14] and face from heat energy from the hair dryer [11]. The hood cover [20] and the head shield [30] are preferably both made from a thin clear or tinted plastic material, having a thickness of between 0.50 and 1.40 millimeters, and more specifically of about 0.70 millimeters. Also, the hood cover [20] and the head shield [30] can be made of different materials depending upon the particular application, The source cover [20] includes vents [44] through which some excess heat energy is enabled to escape. Also, since there are many different types of hooded hair dryers [12], by providing different numbers and configurations of vents [44] of the apparatus [10] is suitable for hair dryers [11] of varying capacities.

Figure 6:
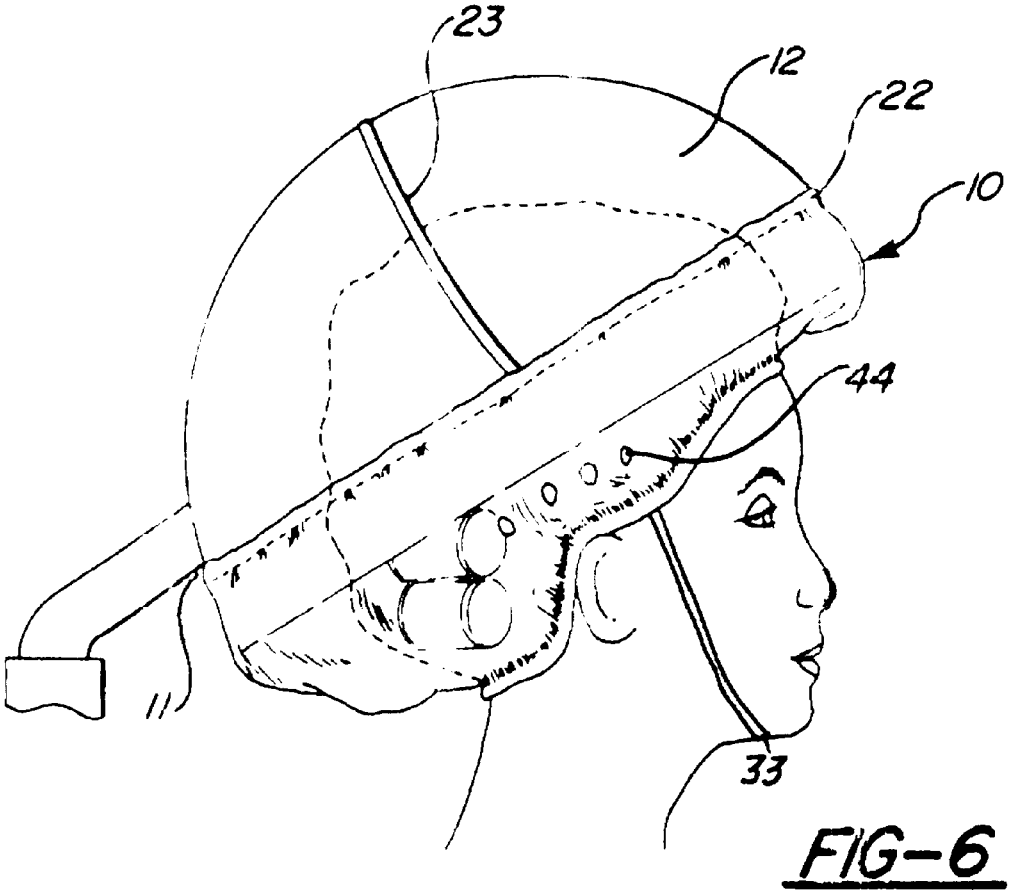
FIG. 6 is a front view of a second embodiment of the combination hair dryer cover and head shield of the present invention.

A second embodiment of the apparatus [10] of the present invention is disclosed in FIG. 6. The apparatus [10] comprises a hood cover [20] made from a thin clear or tinted plastic material, having a thickness of between 0.50 and 1.40 millimeters, and preferably of about 0.70 millimeters. One end of the hood cover [20] is affixed onto the hair-dryer [12] and the other end of the hood cover [20] is placed and retained onto the head [14] of the patron.

To ensure that the apparatus [10] of the present invention is not blown off from the hair dryer [12] once the hair dryer [12] is engaged, more than one hood-cover retainer may be needed. The first hood-cover retainer [22] is preferably an elastic band, such as a rubber band, which is mounted over the outer perimeter of the hood [15], the elastic band being retained thereabout. The second hood-cover retainer [23] is preferably a cut elastic strap that is affixed to the first hood-cover retainer and is generally normal to the first hood-cover retainer [22] when positioned about and retained onto the hair dryer hood [15]. The second hood-cover retainer [23] is positioned over the hair-dryer hood [15] to secure the apparatus of the present invention [10] to the hair dryer hood [15].

Similarly, a second head-shield retainer [33] is positioned under the patron's chin to ensure secure retainment. The second head-shield retainer [33] is affixed to the common perimeter [40] and is preferably a cut elastic band that is normal to the first head-shield retainer [32] when engaged about the patron's chin.

A wide variety of other attachment means may be used, including any combination of bands and straps, some being reinforced double or triple bands, and some being double or reinforced straps. Various configurations of hook-and-loop type fasteners may also be used.

A wide variety of other attachment means may be used, including any combination of bands and straps, some being reinforced double or triple bands, and some being double or reinforced straps. Various configurations of hook-and-loop type fasteners may also be used.

Once the patron's hair has been conditioned, colored, set in a permanent, or the like using the apparatus [10] of the present invention, the patron's hair needs drying. At this point, the heat source power is shut off and the hood cover [20] is separated from the head shield [30] along perforations [48] disposed about the perimeter of the head shield [30] above and proximate to the head shield elastic band [32] positioned about the hairline of the patron. The perforations [48] may be long and aligned slits, rounded aligned punctures, or the like to enable ready separation of the head shield [30] from the hood cover [20]. Once the central portion of the head shield [30] is separated and discarded, one end of the hood cover [20] is repositioned onto the hood [15] of the hair dryers [12] and the other end is repositioned onto the patron's head. The hair dryer is re-energized and hair drying time is reduced since the heat energy is directed onto the damp hair resulting in a significant energy savings and patron convenience. Similarly, perforations can be added to the hood cover and disposed about the perimeter of the hood cover [20] above and proximate to the head shield elastic band [32]. Once the upper portion of the hood cover [20] is separated and discarded, the head shield [30] can thereafter be employed as needed.

While the combination hair dryer cover and head shield apparatus [10] of the present invention has been discussed herein in relation to applications involving a hood-type hair dryer [12], it will be clear to those skilled in the art that the principles of the present invention have additional applications. The apparatus [10] may be used as hand and foot warmers in cold weather. Also, the invention may be used by football players and skiers, for example, in subfreezing temperatures to keep hands and feet warm or for more extensive coverage.

It is evident that many alternatives, modifications, and variations of the combination hair dryer cover and head shield apparatus [10] of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

What is claimed is:

1. A heat directing apparatus for use with a hair dryer hood for drying hair disposed upon a head of a wearer, the apparatus comprising:

a hood first cover being retainable onto the hair-dryer hood by a first retaining element;

a head shield being retainable onto a portion of the head of the wearer by a first head retaining element, the head shield covering the hair to be dried; and means for attaching the hood cover to the head shield.

2. The heat directing apparatus of claim 1, further comprising means for readily separating the hood cover from the head shield, the separating means being disposed about a common perimeter between the hood cover and the head shield.

3. The heat directing apparatus of claim 2, wherein the separating means comprises a plurality of perforations disposed about the common perimeter.

4. The heat directing apparatus of claim 1, further comprising a second hood retaining element for securing the hood cover to the hair dryer hood.

5. The heat directing apparatus of claim 1, further comprising a second head retaining element for securing the head shield to the head of the wearer.

6. A heat directing apparatus for use with a heat source that supplies heat energy by convection to an object to be heated, the apparatus comprising:

a source cover having a first and second source cover end portion, the first source cover end portion being affixed relative to the heat source by an elastic band;

an object cover being adjustably retained by an elastic band onto a portion of the object to be heated, the object cover being securely attached to the second source cover end portion;

means for attaching the source cover to the object cover;

means for readily separating the source cover from the object cover, the separating means being disposed about a common perimeter between the source cover and the object cover;

whereby, the combination of the source cover and the object cover protect portions of the object to be heated and conserve energy projected from the heat source.

7. The heat directing apparatus of claim 6, wherein the separating means comprises a plurality of perforations disposed about the common perimeter.

8. The heat direct apparatus of claim 6, further comprising a second means for securing the source cover to the heat source.

9. The heat directing apparatus of claim 6, further comprising a second means for securing the object cover to the object to be heated.

* * * * *